US006954963B2

(12) United States Patent
McKay

(10) Patent No.: US 6,954,963 B2
(45) Date of Patent: Oct. 18, 2005

(54) LINT REMOVAL APPARATUS WITH PULL TAB FOR ADHESIVE COATED SHEETS

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 298 days.

(21) Appl. No.: 10/080,089

(22) Filed: Feb. 21, 2002

(65) Prior Publication Data

US 2003/0154569 A1 Aug. 21, 2003

(51) Int. Cl.[7] ..... A47L 25/00
(52) U.S. Cl. ..... 15/104.002; 428/192; 428/343
(58) Field of Search ..... 15/104.002, 230.11; 492/13; 428/192, 194, 343

(56) References Cited

U.S. PATENT DOCUMENTS

| | | | | |
|---|---|---|---|---|
| 2,271,189 | A | | 1/1942 | Garthwait |
| 2,506,333 | A | | 5/1950 | Bedynek |
| 2,612,336 | A | | 9/1952 | Tuttle |
| 3,056,154 | A | | 10/1962 | Neal |
| 3,158,887 | A | | 12/1964 | Kanbar |
| 3,299,461 | A | | 1/1967 | Marks |
| 3,373,457 | A | | 3/1968 | Rouch, Jr. |
| D216,942 | S | | 3/1970 | Safalow |
| 3,665,543 | A | | 5/1972 | Nappi |
| 3,742,547 | A | | 7/1973 | Sohmer |
| D238,127 | S | | 12/1975 | Snyder |
| 4,062,083 | A | | 12/1977 | McKay |
| 4,107,811 | A | | 8/1978 | Imsande |
| 4,320,158 | A | * | 3/1982 | Seeley ..... 428/42.3 |
| 4,361,923 | A | | 12/1982 | McKay |
| 4,399,579 | A | | 8/1983 | McKay |
| 4,422,201 | A | | 12/1983 | McKay |
| 4,489,912 | A | | 12/1984 | Haythornthwaite |
| 4,519,566 | A | | 5/1985 | Manzi |
| 4,727,616 | A | | 3/1988 | Kucera et al. |
| 4,905,337 | A | | 3/1990 | McKay |
| D311,995 | S | | 11/1990 | Garcia |
| D314,282 | S | | 2/1991 | Gingras |
| 5,027,465 | A | | 7/1991 | McKay |
| D320,680 | S | | 10/1991 | Stetson et al. |
| D342,610 | S | | 12/1993 | Stetson et al. |
| 5,878,457 | A | | 3/1999 | Cox et al. |
| 5,940,921 | A | | 8/1999 | Wood et al. |
| D419,306 | S | | 1/2000 | Hansen et al. |
| 6,014,788 | A | | 1/2000 | Jaffri |
| 6,055,695 | A | | 5/2000 | McKay, Jr. |
| 6,127,014 | A | | 10/2000 | McKay, Jr. |
| D441,538 | S | | 5/2001 | Petner |
| D446,023 | S | | 8/2001 | Sherman |
| 6,298,517 | B1 | | 10/2001 | McKay |
| 6,321,408 | B1 | | 11/2001 | Esterson et al. |
| 6,756,102 | B1 | | 6/2004 | Galo |
| 2002/0088070 | A1 | * | 7/2002 | Cho ..... 15/104.002 |
| 2002/0144367 | A1 | | 10/2002 | McKay, Jr. |
| 2003/0096074 | A1 | | 5/2003 | Kim |
| 2004/0154133 | A1 | | 8/2004 | Polzin et al. |
| 2004/0194240 | A1 | | 10/2004 | McKay, Jr. |

FOREIGN PATENT DOCUMENTS

| | | | |
|---|---|---|---|
| JP | 4-226581 | * | 8/1992 |

* cited by examiner

*Primary Examiner*—Randall Chin
(74) *Attorney, Agent, or Firm*—Jeffery M. Kaden; Gottlieb, Rackman & Reisman, P.C.

(57) ABSTRACT

A pull tab is formed at a separable edge of each of a plurality of individually separable sheets of outwardly faced adhesive tape wound into a roll by a non-adhesive portion carried on the adhesive layer of the tape to facilitate gripping and removal of an outermost sheet from the tape roll to expose an underlying sheet. The separable edges extend at least partially through the tape roll dividing the tape into a plurality of separable sheets.

15 Claims, 4 Drawing Sheets

LINT REMOVAL APPARATUS WITH PULL TAB FOR ADHESIVE COATED SHEETS

BACKGROUND

This invention relates generally to tools for picking up particles from surfaces such as clothing, pets, floors, carpets, furniture, and more specifically, to an adhesive tape lint remover having removable cleaning sheets.

FIELD OF THE INVENTION

Surfaces such as floors, clothing, pets, and furniture are most aesthetically pleasing and safe when they are clean, free from unsightly particles. Unfortunately these surfaces typically become soiled with particles from the environment, such as pets shedding hair, settling dust particles, dandruff from dry scalps and pets. Numerous devices and methods have been developed for returning a surface to a clean, particle free condition and people are constantly striving to develop better methods. Sweeping, brushing, vacuuming or using adhesive tape lint removers work well. However, most suffer from the drawback of being time consuming and difficult. For example, a small piece of lint, dandruff or hair may be located on an article of clothing or floor. Using a vacuum requires a person to locate the vacuum cleaner, uncoil and plug in a power cord, select the correct attachments, vacuum up the hair or lint and reverse the process to put the vacuum cleaner away. Likewise using a brush simply moves particles from one surface to another and requires either picking the hair or lint up from another surface or cleaning the brush. Alternatively a person may use an adhesive tape lint remover. This is also undesirable for many people since it is difficult to grasp individual layers and remove one at a time. Some persons may find locating and grasping individual sheets difficult and uncomfortable as they have physical limitations. Other people may find the dry edges unacceptable as they reduce the quantity of adhesive surface area for cleaning. Therefore, there is a need for improved devices and methods for simple cleaning duties such as removing lint, pet hair, and dandruff from clothing or floors. Previous attempts to address this need include lint removal brushes with directional fabric, adhesive tape lint removers with non-adhesive edges, electrostatic charged dusting cloths, and small hand held vacuum cleaners. However these solutions do not adequately address the needs of typical homeowners.

SUMMARY OF THE INVENTION

The present invention is a lint removal apparatus including a tape roll in which a unique pull tab is formed along the tape roll at the location of the separable edge defining each individual sheet of the tape roll to facilitate gripping and removal of an outermost sheet from the next underlying inner sheet.

In one aspect, the lint removal apparatus includes:

a tape wound in a roll and formed of a substrate with opposed side edges and first and second major opposed surfaces;

an adhesive layer carried on one major surface of the tape;

the tape wound into a roll with the adhesive surface facing outwardly from the tape;

a separable edge extending at least partially through the roll dividing the roll into a plurality of individually separable sheets; and a pull tab formed over a substantially non-adhesive portion carried between the side edges on one of the first and second surfaces of the substrate, the non-adhesive portion disposed in registry with the separable edge to define the pull tab at the separable edge of each sheet on the roll to facilitate removal of an outermost sheet from the roll.

The present invention, in another aspect, also defines a method for manufacturing a lint removal apparatus. The method comprises the steps of:

providing an elongate flexible substrate with first and second opposed surfaces and first and second side edges;

affixing an adhesive layer on one of the first and second surfaces of the substrate;

providing a pull tab defined by a substantially non-adhesive area on the adhesive layer on a separable edge sheet on the tape;

winding the tape into a roll with the adhesive layer facing outwardly of the roll; and forming the separable edge at least partially through the roll dividing the roll into individually separable sheets.

The unique pull tab of the present invention provides advantages for a lint removal assembly tape roll by enabling easy gripping and removal of an outermost soiled sheet from the next innermost clean sheet of the tape roll without pulling additional sheets from the roll or having to pry the exposed end edge of the outermost sheet from the underlying adhesive coated layer. The pull tab defines a minimal non-adhesive area on the tape roll thereby providing greater exposed adhesive surfaces on each tape roll sheet as compared to prior lint removal tape rolls having dry edges along at least one and typically both side edges of the tape.

BRIEF DESCRIPTION OF THE DRAWINGS

The various features, advantages and other uses of the present invention will become more apparent by referring to the following detailed description and drawing in which.

DETAILED DESCRIPTION

Figure 1:
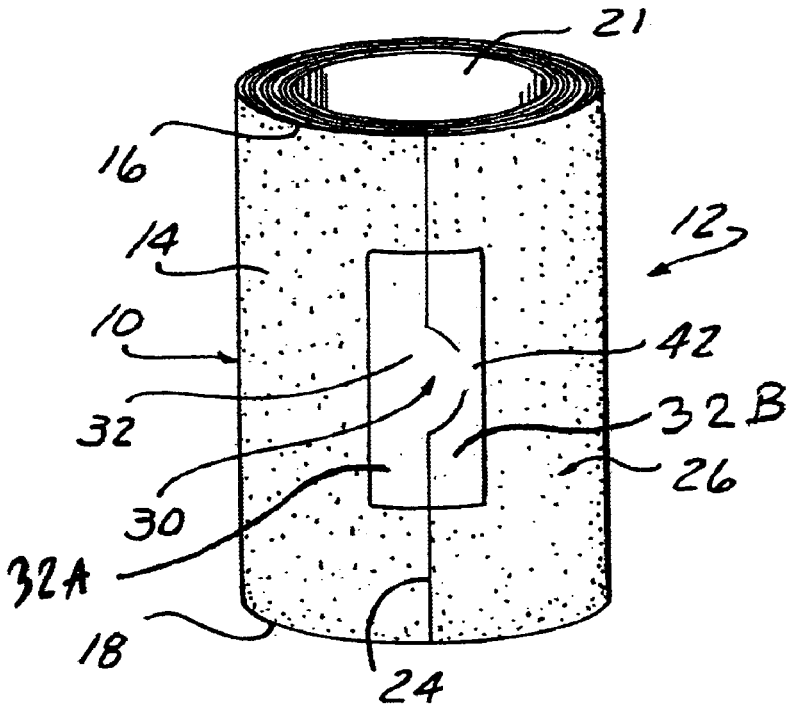
FIG. 1 is a perspective view of a lint removal apparatus according to one aspect of the present invention.

Referring now to FIG. 1, there is depicted a tape roll 10 for a lint removal apparatus 12 according to the present invention. The tape 14 wound into the roll form 10 is preferably formed of at least two material layers, one constituting a substrate or backing layer and the other constituting an adhesive layer, both having opposed side edges 16 and 18 and opposed, major, first and second surfaces 20 and 22.

The substrate 14 is formed of a suitable material, such as silicone coated flat backed paper or crepe paper or plastic film. Any, suitable paper and plastic films, known in the relevant industry, may be employed. The substrate 14 can be opaque, transparent, colored or have printed indicia thereon as well as being formed with different surface textures or embossments.

The adhesive layer is disposed on or applied to substantially all or one major surface 20 or 22 of the substrate 14. According to the present invention, the adhesive layer is applied to the substantially all of one major surface 20 or 22 of the substrate 14 between the side edges 16 and 18.

Suitable adhesives which form a tacky, partially pressure sensitive surface for picking up lint and debris from other surfaces as generally known in the relevant industry may be employed. Typically, such adhesives are known as "pressure sensitive" adhesives and are normally tacky at room temperature. Such adhesives can be adhered to a surface by the application of light pressure.

Further details concerning the types of materials which can used to form the substrate 14 and the adhesive layer may be found by referring to U.S. Pat. No. 5,027,465, the relevant portions of which pertaining to the substrate and adhesive materials are incorporated herein by reference.

As shown in FIG. 1, the tape 10 is wound into a continuous roll about a core or in a coreless fashion. An interior bore 21 is formed in the roll 10 for the core, if used, and/or for receiving a rotatable handle element as described hereafter and shown in FIGS. 13 and 14.

A separable edge 24 is formed substantially through the roll 10 at one location between the side edges 16 and 18. The separable edge 24 divides the tape 10 into a series of end to end arranged sheets 26. As described hereafter, the outermost sheet 26 may be removed from the roll 10 after it is soiled thereby to enable a new clean sheet 26 to replace the soiled and removed outer sheet on the exterior surface of the roll 10.

Figure 2:
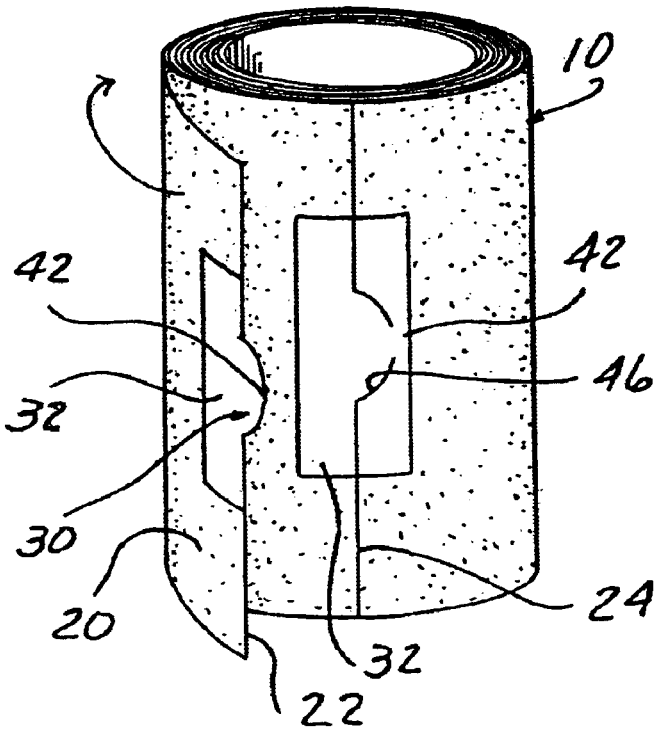
FIG. 2 is a perspective view of the lint removal apparatus of FIG. 1 shown at the beginning of the outermost sheet removal from the roll.
Figure 3:
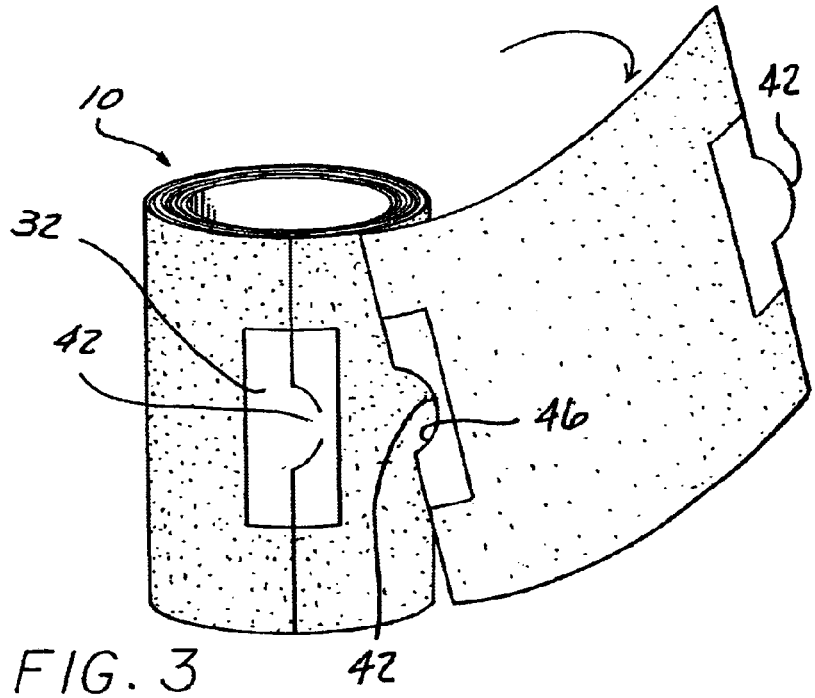
FIG. 3 is a perspective view of the lint removal apparatus of FIGS. 1 and 2, showing the complete separation of an outermost sheet from the roll.

According to the present invention, a unique pull tab denoted in general by reference number 30 is provided in registry with the separable edge 24 of each sheet 26. One portion of the pull tab 30 extends across the edge 24 so it can be easily separated from the surrounding adhesive on the underlying sheet 26 to allow the edge 24 of the outer most sheet 26 to be pulled away from the roll 10 as shown in FIGS. 2 and 3, unwound and removed from the roll 10.

Figure 4:
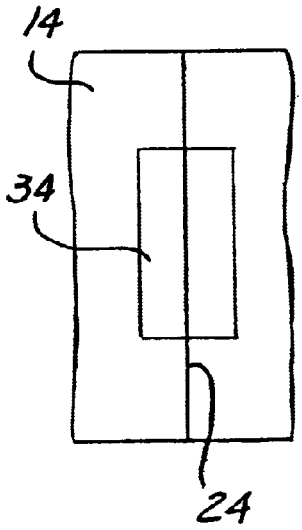
FIG. 4 is a partial, plan view of one aspect of a pull tab according to the present invention.
Figure 5:
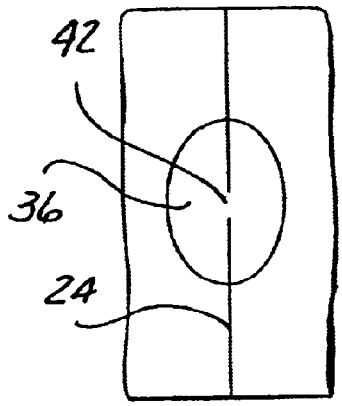
FIG. 5 is a partial, plan view of another aspect of the pull tab of the present invention.

The pull tab 30, shown ad described hereafter in many aspects, is part of a substantially non-adhesive area 32 which is formed by various means, also described hereafter, on the adhesive layer of each sheet. 26. Preferably, the non-adhesive area 32 is disposed in registry with the separable edge 24 of each sheet 26 from the roll 10 The term "registry" will be understood to encompass configurations where the area 32 of the pull tab 30 overlays and spans the separable edge 24 or is disposed in contact with a portion of the edge 24 such that the entire area 32 extends away from the edge 24 and does not span the edge 24. As shown in FIGS. 4 and 5, the non-adhesive area 32 can take different configurations, such as a polygonal configuration 34 shown in FIGS. 1–4, and 6–10, where the area 32 has a square, rectangular or other polygonal shape, or a circular configuration 36 as shown in FIG. 5. The non-adhesive areas 32 can also be provided in a color different than the color of the tape or printed with indicia, such as "pull here". As seen in the FIG. 1, the area 32 is substantially severed by the edge 24 into two segments 32A and 32B.

The pull tab 30 can be formed in a number of different ways, each defining a tab adjoining a part of the sheet 26 on the roll 10 but which has a non-adhesive radially outermost surface to allow the pull tab 30 on the outermost sheet 26 to be easily grasped and pulled to facilitate removal of the outer sheet 26 from the roll 10.

For example, the non-adhesive area 32 can be formed of a thin material layer or sheet, including, but not limited to, plastic films, non-woven fabrics, papers, Tyvek, which has at least one substantially non-adhesive surface. Alternately, the non-adhesive area 32 can be formed of a coating, such as a UV cured or fast drying material, such as silicone or varnish, or a transferable ink including a stamped or jet sprayed ink. According to the present invention, "non-adhesive" area means an area or surface which has or is formed of a partial or complete non-adhesive surface or coating. For example, silicone or varnish can be screened onto the adhesive layer so as to cover a portion of the adhesive layer, i.e. 90%, for example, and thereby provide a slightly tacky surface which can assist in pulling the next pull tab away from the tape roll 12.

Further, the non-adhesive area 32 is formed on the roll 10 in the location of each separable edge 24 between adjacent wound sheets 26 so that the pull tabs 30 and non-adhesive areas 32 overlay each other. The non-adhesive areas 32 are longitudinally spaced along the length of the tape 12 the spacing between consecutive non-adhesive areas 23 can be equal or non-equal. The non-adhesive areas 32, while depicted as being centered between the side edges 16 and 18 of the tape 12, can be formed at any other position between the side edges 16 and 18.

Alternately, the pull tab 30 can be defined as a non-adhesive portion of the substrate of the tape 12 wherein the area 32 is masked or blocked off from the application of adhesive to the substrate during the coating of the substrate of tape 12.

As described above, the pull tab 30 may be formed on different combinations of area configurations, such as areas 32, 34 and 36 as well as different edge shapes as described hereafter.

In FIGS. 1 and 4, the separable edge 24 between adjacent sheets 26 on the roll 10 extends completely through the roll 10. The pull tab 30 which overlays the non-adhesive area 34 in FIG. 4 enables a user to insert his or her finger or fingernail beneath the edge 24 and raise the end of the tab 30 away from the roll 12.

The separable edge 24 may also be discontinuous as shown by the discontinuous line 42 in FIG. 5 which is formed between two continuous severed or slit portions extending at least partially through the entire roll 10. The discontinuity 42 defines a bridge which assists in maintaining the integrity of the slit or cut in the tape roll 10. It is known that some roll tapes have memory which is defined as the tendency of the tape to return to its original elongated shape prior to winding into a roll. This shape memory can make the tape roll open up at the slit or "butterfly." The bridge 42 assists in maintaining the roll 24 in its desired wound shape. This is shown more clearly in FIGS. 2 and 3 where the discontinuity or bridge 42 remains connected to the underlying clean sheet 26 until the outer soiled sheet is completely unwrapped from the roll 10. Just before the outer sheet 26 completely separates from the roll 10, the bridge 42 then rips away and actually lifts the pull tab 30 radially outward thereby providing easy access to the next sheet 26 to be removed when soiled.

Figure 7:
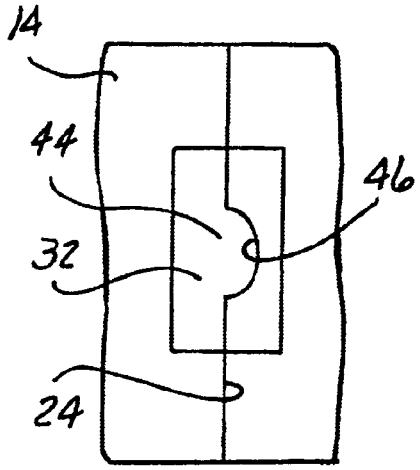
FIG. 7 is a partial, plan view of another aspect of the pull tab of the present invention.

FIG. 7 depicts a pull tab 44 which is formed by a notch 46, in the form of a semi-circle, in the separable edge 24. The notch 46 overlays the non-adhesive area 32 and provides the tab 44 for a user's finger to begin the separation of the outer sheet 26 from the roll 10.

Figure 8:
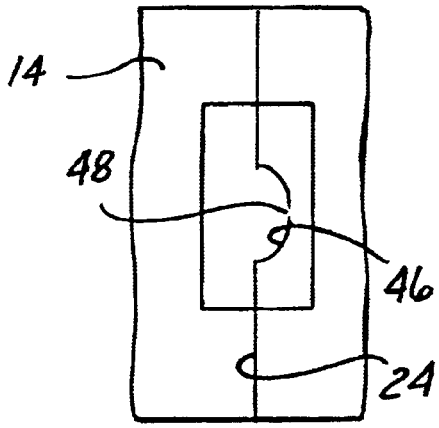
FIG. 8 is a partial, plan view of another aspect of the pull tab of the present invention.

In FIG. 8, the notch 46 is provided with a discontinuity which acts as a bridge 48 as described above for the bridge 42 shown in FIG. 5.

Figure 9:
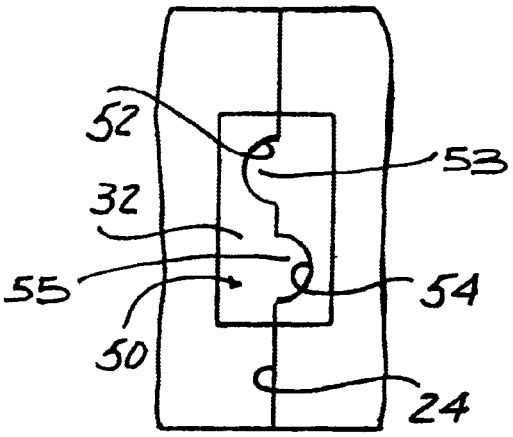
FIG. 9 is a partial, plan view of another aspect of the pull tab of the present invention.

In FIG. 9, a pull tab 50 is disclosed in which a portion of the separable edge 24 overlaying the non-adhesive area 32 is provided with two oppositely directed notches 52 and 54, each shown in the form of a semi-circle, by example only. Such recess 52 and 54 provides a tab 53 and 55, respectively, which can be engaged by the user's fingers.

Figure 10:
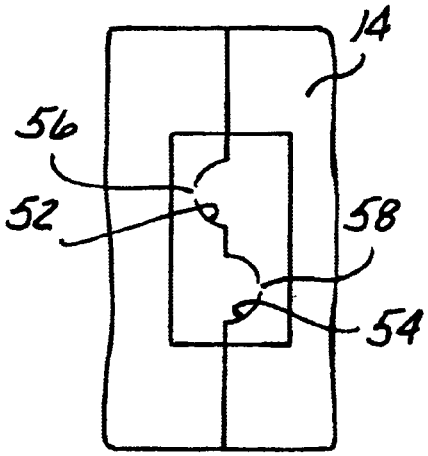
FIG. 10 is a partial, plan view of another aspect of the pull tab of the present invention.

In FIG. 10, the recesses 52 and 54 are illustrated as including a discontinuity or bridge 56 and 58, respectively. The bridges 56 and 58 function in the same manner as the discontinuities or bridges 42 and 48 described above.

Referring back to FIG. 6, the separable edge 60, in this aspect of the invention, is formed as a score line or series of perforations including alternating connected and disconnected, severed or partially severed slits 62 extending at least partially through the roll 10 and the non-adhesive area 32.

Figure 6:
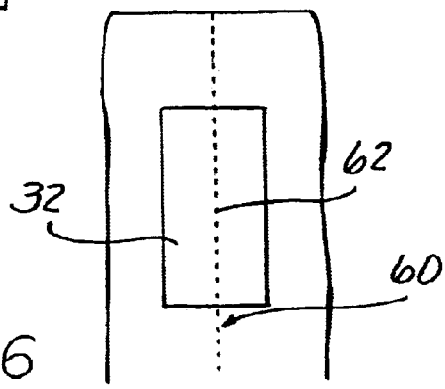
FIG. 6 is a partial, plan view of another aspect of the pull tab of the present invention.

It is also possible to redefine the shape of the perforations 62 shown in FIG. 6 by providing a larger discontinuity in the central portion of the edge of the perforation 60 generally overlaying a large portion of the pull tab area 32. This larger discontinuity acts as a separable connecting bridge as described above.

Figure 11:
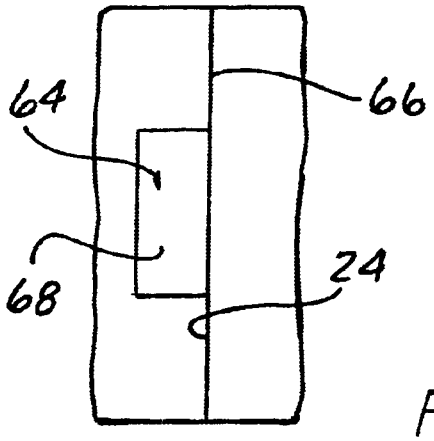
FIG. 11 is a partial, plan view of another aspect of the pull tab of the present invention.

In FIG. 11, a pull tab 64 is disclosed in which an edge 66 of the entire non-adhesive area 68 defining the pull tab 64 is aligned with the separable edge 24 extending through the roll 10. The non-adhesive area 68 still defines an easy access point for the user's finger to engage the portion of the edge 24 of the outermost sheet to begin separation of the outermost sheet 26 from the roll 10.

All of the different pull tab configurations described above operate in the same manner to enable easy removal of an outermost sheet 26 from the roll 10. As shown in FIGS. 2 and 3, the user grasps a portion of the pull tab 30 overlaying the non-adhesive area 32 to the left side of the separable edge 24 in the orientation shown in FIG. 2 and exerts a radially outward pulling force to separate one edge of the outermost sheet 26 from the roll 10. The outermost sheet is unwound from the roll 10 until the other end of the sheet 26 pulls free of the roll 10 as shown in FIG. 3. This leaves a new, clean outermost sheet 26 having one portion of the non-adhesive area 32 on one side of the separable edge and another portion of the non-adhesive area 32 on the other side of the edge 24.

The pull tabs and non-adhesive areas have been described as being formed on an outermost surface of the sheets 26 when the sheets are wound in the form of the roll 10. It is also possible to mount the pull tabs and the non-adhesive areas on the back surface of each sheet 26 when the sheets 26 are wound into the roll 10. However, since the back surface of the sheets already have a limited amount of non-adhesive qualities so as to enable an easy pulling of an outermost sheet 26 from the underlying sheet 26 during removal of the outermost sheet from the roll 10, the non-adhesive areas would have to have a greater non-adhering capability so as to permit easier release or actually a total lack of adhesion between the outermost sheet and an underlying sheet in the non-adhesive area.

Figure 12B:
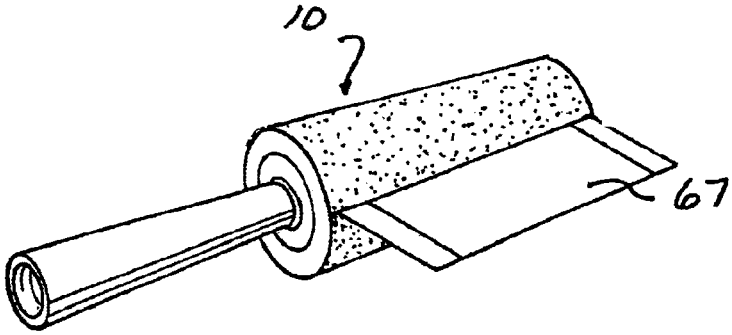
FIGS. 12A and B are perspective views of pull tabs carried on the back or under surface of the tape roll.
Figure 12A:
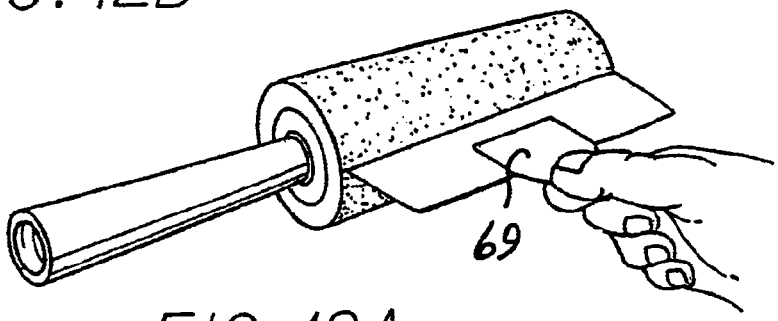

It is also possible in an aspect of the invention to form the pull tabs on the back surface of each sheet 26, and to have pull tabs 69 formed intermittently in a longitudinally spaced manner as shown in FIG. 12A in the same manner as the formation of the pull tabs on the outer surface of the sheets 26 as well as in a continuous longitudinal stripe along the entire longitudinal extent of the back surface of the tape as shown in FIG. 12B.

Figure 13:
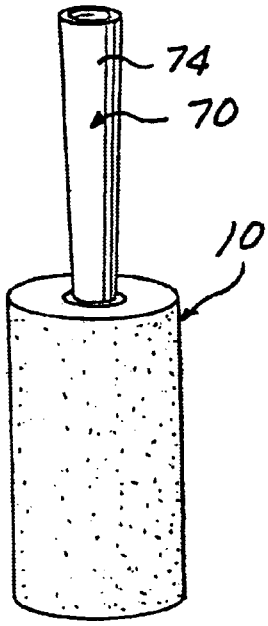
FIG. 13 is a perspective view of the lint removal apparatus of the present invention mounted on a one aspect of a handle.
Figure 14:
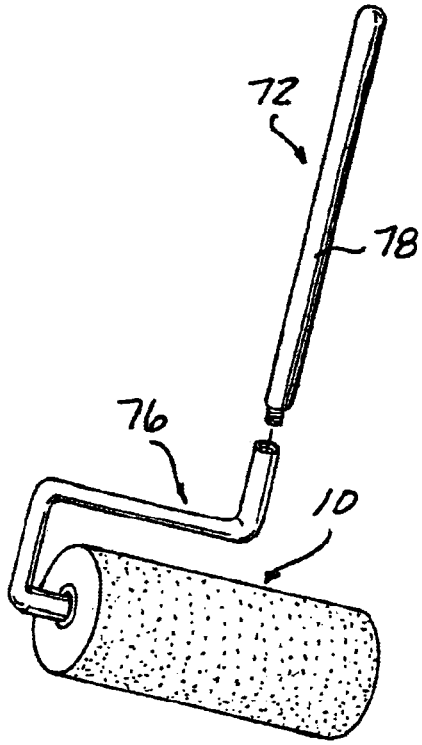
FIG. 14 is a perspective view of the lint removal apparatus of the present invention mounted on another aspect of a handle.

FIGS. 13 and 14 disclose alternate handles 70 and 72, respectively, which may be used to conveniently manipulate the tape roll 10 to pick up debris, dirt, lint, etc. The handle 70 has an end portion which defines a hand grip 74. An opposite end portion, not shown, releasably receives the roll 10, typically in a press fit, by example only. In FIG. 14, the handle 72 has a bent end portion 76, one end of which releasably receives the roll 10, such as in a press fit, by example only. The bent end portion 76 can have a continuous, elongated hand grip portion 78. Alternately, as shown in FIG. 14, the hand grip portion 78 is releasably attachable to the bent portion 76 so that the handgrip portion 78 functions as an extension. Threads, snap together, press fit, connections, etc., may be employed between the handgrip portion 78 and the bent portion 76.

In summary, there has been disclosed a unique lint remover which provides non-adhesive pull tabs along the separable edges between adjacent sheets of a tape roll to facilitate easy removal of a soiled outermost sheet from the roll to expose a clean inner disposed sheet.

What is claimed is:

1. A tape roll for a lint removal roller assembly comprising:

a tape formed of a substrate having opposed side edges and first and second major opposed surfaces of the tape;

an adhesive layer carried on one major surface;

the tape wound into a tape roll with the adhesive layer facing outwardly from the roll;

a separable edge extending at least partially through the roll dividing the roll into a plurality of individually separable sheets said separable edge includes planar and non-planar portions; and a plurality of pull tabs formed by a plurality of spaced, substantially, non-adhesive portions carried between the side edges of the substrate, each non-adhesive portion disposed as a layer on the adhesive layer and being substantially split by said separable edge into two segments, one segment forming one pull tab on each sheet on the roll to facilitate removal of an outermost sheet from the roll.

2. The tape roll of claim 1 wherein each non-adhesive portion comprises:

a substantially non-adhesive coating formed in a plurality of longitudinal spaced locations on one of the first and second major surfaces of the tape.

3. The tape roll of claim 1 wherein each non-adhesive portion comprises:

a thin sheet having a substantially non-adhesive surface.

4. The tape roll of claim 3 wherein:

the thin sheet is adhesively fixed to the adhesive layer on the tape.

5. The tape roll of claim 1 wherein:

each non-adhesive portion has a polygonal shape.

6. The tape roll of claim 1 wherein:

each non-adhesive portion has a circular shape.

7. The tape roll of claim 1 wherein:

the separable edge is in the form of a slit extending at least partially through the tape roll.

8. The tape roll of claim 1 wherein:

the separable edge is a planar slit extending at least partially through the tape roll.

9. The tape roll of claim 1 wherein:

the separable edge is a perforated slit extending at least partially through the tape roll.

10. The tape roll of claim 1 wherein:

the separable edge is a discontinuous slit extending at least partially through the tape roll.

11. The tape roll of claim 1 wherein:

the pull tab extends longitudinally from the separable edge in the tape.

12. The tape roll of claim 1 wherein each non-adhesive portion comprises:

a non-adhesive material coating disposed on the tape.

13. The tape roll of claim 1 wherein each non-adhesive portion comprises:

a material layer fixed on the tape and having a non-adhesive surface facing outward from the adhesive layer on the tape.

14. The tape roll of claim 1 wherein:

the separable edge is co-extensive with an edge of a respective non-adhesive portion of the pull tab.

15. The tape roll of claim 1 wherein:

the non-adhesive portions have at least a partial, non-adhesive surface.

* * * * *